US005561239A

United States Patent [19]

Yasuda

[11] Patent Number: 5,561,239

[45] Date of Patent: Oct. 1, 1996

[54] MISFIRE DETECTING CIRCUIT FOR INTERNAL COMBUSTION ENGINE

[75] Inventor: Yukio Yasuda, Itami, Japan

[73] Assignee: Mitsubishi Denki Kabushiki Kaisha, Tokyo, Japan

[21] Appl. No.: 379,294

[22] Filed: Jan. 27, 1995

[30] Foreign Application Priority Data

Jan. 28, 1994 [JP] Japan ..... 6-008880

[51] Int. Cl.[6] ..... F02D 1/00; F02P 9/00

[52] U.S. Cl. ..... 73/35.08; 73/115; 324/399; 324/460

[58] Field of Search ..... 73/35.08; 324/378, 324/399, 393, 460

[56] References Cited

U.S. PATENT DOCUMENTS

| | | | |
|---|---|---|---|
| 5,180,984 | 1/1993 | Murata | 324/378 |
| 5,271,268 | 12/1993 | Ikeuchi et al. . | |
| 5,293,129 | 3/1994 | Ikeuchi et al. | 324/399 |
| 5,396,176 | 3/1995 | Ishii | 324/399 |
| 5,397,990 | 3/1995 | Ohsawa | 324/399 |
| 5,444,375 | 8/1995 | Ohsawa | 324/399 |

*Primary Examiner*—Kenneth A. Wieder
*Assistant Examiner*—Jose M. Solis
*Attorney, Agent, or Firm*—Leydig, Voit & Mayer

[57] ABSTRACT

There is provided a misfire detecting circuit for an internal combustion engine for detecting a misfire on the basis of the presence or absence of an ion current caused by combustion by applying a voltage to an ignition plug of the internal combustion engine, which circuit prevents malfunction caused by stray capacitance generated in the line up to the ignition plug and by the input impedance of the circuit. The misfire detecting circuit includes an ion current detection section which is formed of a diode for causing electric current to flow out from a capacitor, which diode is connected between the ground and the electrode on the low potential side of the capacitor which is charged by electric current at the time of ignition and charged to a predetermined voltage for detecting the ion current, and a current/voltage conversion section which is formed of a diode for causing electric current to flow out and of an operational amplifier whose inverting input is connected to the electrode on the low potential side of the capacitor and whose non-inverting input is connected to the ground.

7 Claims, 14 Drawing Sheets

9b

MISFIRE DETECTING CIRCUIT FOR INTERNAL COMBUSTION ENGINE

BACKGROUND OF THE INVENTION

1. Field of the Invention

The present invention relates to a misfire detecting circuit for an internal combustion engine for detecting a misfire by detecting an ion current in the combustion chamber of a internal combustion engine.

2. Description of the Related Art

In internal combustion engines, a mixture gas of fuel and air is compressed, and a mixture gas is combusted by a spark generated by applying the high voltage to an ignition plug disposed in the combustion chamber. A state in which the mixture gas is not combusted is called a misfire. When the internal combustion engine is misfiring, output performance is reduced and a mixture gas containing a large amount of fuel flows into an exhaust system. Fuel in the exhaust system causes a problem, for example, in that an exhaust silencer is corroded. Therefore, it is necessary to detect a misfire state and to warn the operator.

As a misfire detection apparatus, there is an apparatus for detecting a misfire by detecting ion current in the combustion chamber. When combustion is performed in the combustion chamber, molecules in the combustion chamber are ionized as a result of the combustion. When a voltage is applied to the inside of the ionized combustion chamber through an ignition plug, a very small current flows, which is called ion current. Since the ion current becomes exceedingly small at the time of misfire, it is possible to detect this ion current and to determine whether a misfire has occurred. The present invention is concerned with a misfire detecting circuit for an internal combustion engine for detecting a misfire by detecting the ion current.

FIG. 20 illustrates a conventional misfire detecting circuit disclosed in, for example, Japanese Patent Laid-Open No. 4-191465.

Referring to FIG. 20, reference numeral 1 denotes an ignition coil; reference numerals 1*a* and 1*b* denote the primary coil and the secondary coil, respectively; and reference numeral 3 denotes an ignition plug which is connected to the negative polarity side of the secondary coil 1*b*. The positive polarity of the primary coil 1*a* is connected to a power source 8, and the negative polarity thereof is connected to the collector of a transistor 2 for storing electric current. The emitter of the transistor 2 is connected to the ground, and the base is controlled by a control apparatus (not shown) for controlling combustion.

Reference numeral 9 denotes a misfire detecting circuit; reference numeral 5 denotes a capacitor connected to the positive polarity; reference numeral 6 denotes a diode 6 connected between the low electrical potential side of the capacitor 5 and the ground, which diode is connected in a direction in which the capacitor 5 side is formed into the anode. Reference numeral 4 denotes a Zener diode which determines the voltage to be charged in the capacitor 5, which diode is connected between the positive polarity of the secondary coil 1*b* and the ground; and reference numeral 7 denotes a resistor.

In such a circuit constructed as described above, when the internal combustion engine is ignited, the transistor 2 changes its state suddenly from on to off under the control of a control apparatus (not shown) for controlling combustion. At this time, the primary current of the ignition coil 1 decreases sharply, and a high voltage is generated by a counter electromotive force of the coil. On the secondary side of the ignition coil 1, a voltage developed on the primary side develops in such a way that the voltage is amplified in accordance with the coil winding ratio of the primary coil 1*a* to that of the secondary coil 1*b*. Therefore, a voltage of approximately −10 KV to −25 KV is resultingly applied to the ignition plug 3.

In the circuit of FIG. 20, a charge sufficient for detecting ion current is stored in the capacitor 5 by using energy at the time of ignition, and ion current is detected immediately after ignition by a voltage supplied from the capacitor 5. The electric current at the time of ignition flows in the direction of the arrow 3*a* of FIG. 20, causing discharge at the ignition plug 3 and thus the mixture gas in a combustion chamber 30 is ignited. This discharge current charges the capacitor 5 up to the voltage limited by the Zener diode 4.

When the electric current in the direction of the arrow 3*a* for ignition decreases to zero, the voltage held by the capacitor 5 is applied to the ignition plug 3. At this time, when combustion is normally performed in the combustion chamber 30, the ion current flows in the direction of the arrow 3*b*. Since the electric current flowing in the direction of the arrow 3*b* flows through the resistor 7, a voltage drop is caused. By using this voltage drop as a detection signal, the presence or absence of a misfire is determined based on this voltage drop. That is, since no ion current flows in the case of a misfire, a voltage caused by this ion current does not develop in the output.

Another examples of such a misfire detecting circuit for an internal combustion engine are disclosed in Japanese Patent Laid-Open Nos. 4-265474 and 4-262070. However, these misfire detecting circuits have the problems which will be described below.

<STRAY CAPACITANCE>

The misfire detecting circuit is, in practice, disposed inside an engine compartment of an automobile together with an ignition coil. The misfire detecting circuit is installed in various arrangements depending upon the engine construction or the like. There may be a case in which with respect to a long section between the ignition coil 1 and the ignition plug 3 in FIG. 20, such distance approximately 2 m. When the wiring becomes long, a stray capacitance is generated between it and the wiring of another potential, particularly, the ground.

In the case of the circuit of FIG. 20, if the stray capacitance with respect to the ground is Cf [F] (farad), a series circuit of the stray capacitance Cf, the capacitor 5 and the resistor 7 is formed. The operation of this series circuit is greatly influenced by a charging/discharging time constant determined by the stray capacitance Cf and the resistance value of the resistor 7, and a problem such that, in particular, the time width of a noise signal is increased arises. In an actual example, for a noise signal of 100 μsec (microsecond) and 10 mA (milliampere) to attenuate to less than 1 μA (microampere), which is not problematical in comparison with the ion current, if the stray capacitance Cf is 500 pF (picofarad) and the resistor 7 has 200 KΩ (kilohm), a time of approximately 1 msec (millisecond) is necessary, and the noise current waveform expands approximately to ten times as great. As a result, there is the possibility that noise is erroneously detected as ion current.

Conceivable countermeasures are: the resistance value of the resistor 7 is decreased, and the stray capacitance is decreased. However, a decrease in the resistance value causes a problem, for example, it is impossible to detect a misfire in a low rotation region where the ion current value decreases due to the decrease in the misfire detection sensitivity. Also, a decrease in the stray capacitance poses a great limitation on the place where the misfire detecting circuit is disposed and the disposition method.

<Dark Current>

During ion current detection, the ignition and misfire inside the combustion chamber are determined on the basis of the size of the ion current. However, the electric current flowing at the time of the misfire is not completely zero, but a current of approximately 1/100 to 1/50 of that at the time of ignition flows. The electric current at this time is called a dark current.

The ion current has a characteristic which is dependent on the number of rotations of the engine. Generally speaking, the current value is great at a great number of rotations, and the current decreases at a small number of rotations. The value reaches approximately tens of times between the idling rotation of 500 to 1,000 rotations/min and a great number of rotations of 6,000 to 8,000 rotations/min.

The dark current increases nearly in proportion to the ion current. The dark current at a great number of rotations becomes approximately the same amount as the ion current at a small number of rotations. Therefore, if the detection threshold value of the ion current is constant and if it is adjusted to the characteristic at a small number of rotations, the dark current at the time of the misfire is erroneously detected as the ion current at a great number of rotations, and if, on the contrary, it is adjusted to the characteristic at a great number of rotations, it becomes impossible to detect the ion current at a small number of rotations. These problems hinder the realization of a misfire detecting circuit capable of responding to a wide range of rotations of the engine.

<Leak Current>

Although the ignition plug in the combustion chamber is insulated, the insulation may decrease due to the deposition of the fuel, carbon or the like depending upon operating conditions. In such a case, ignition characteristics deteriorate. However, in the case of today's internal combustion engines, it is possible to discharge a spark without problems if the ignition plug has approximately 10 MΩ (megaohm). However, the leakage current which flows when the insulation resistance becomes 10 MΩ becomes greater than the ion current at a small number of rotations, and thus the leak current is detected as an ion current at the time of misfire. Primarily, when the insulation resistance decreases, a misfire is most likely to occur. The erroneous detection in situations where a misfire is likely to does not fulfill the misfire detection function, which is problematical.

In the misfire detecting circuit for an internal combustion engine constructed as described above, no countermeasures are taken for the stray capacitance, the dark current or the leak current described above. Thus, an erroneous detection of a misfire may occur.

SUMMARY OF THE INVENTION

The present invention has been are achieved to solve the above-described problems of the prior art. An object of present invention is to provide a misfire detecting circuit for an internal combustion engine having improved reliability in which erroneous detection due to stray capacitance, dark current or leak current is prevented.

To achieve the above object, according to a first aspect of the present invention, there is provided a misfire detecting circuit for an internal combustion engine, the misfire detecting circuit comprising: ion current detecting means for applying a positive polarity voltage to an ignition plug of a cylinder of an internal combustion engine and for detecting ion current of negative polarity caused by combustion; and current/voltage conversion means for converting the ion current of negative polarity to a positive polarity voltage, wherein the ion current detecting means comprises a capacitor, charged by electric current from outside, for holding the positive polarity voltage, a voltage limiting circuit for limiting the voltage of the capacitor, and a first diode, connected between the electrode on the low potential side of the capacitor and the ground, for causing electric current to flow out from the capacitor, the current/voltage conversion means comprises a second diode, connected between the connection point of the capacitor and the first diode and the ground so that the capacitor side becomes the cathode, for supplying electric current to the capacitor, and a circuit having a small input impedance including an operational amplifier whose inverting input is connected to the connection point of the capacitor and the first diode and whose non-inverting input is connected to the ground, for converting ion current which flows out from the capacitor to a voltage, and erroneous detection caused by the input impedance and stray capacitance generated in the circuit is prevented by decreasing the input impedance of the current/voltage conversion means.

According to a second aspect of the present invention, there is provided a misfire detecting circuit for an internal combustion engine, the misfire detecting circuit comprising: ion current detecting means for applying a positive polarity voltage to an ignition plug of a cylinder of an internal combustion engine and for detecting ion current of negative polarity caused by combustion; and current/voltage conversion means for converting the ion current of negative polarity to a positive polarity voltage, wherein the current/voltage conversion means comprises an operational amplifier for converting ion current to a voltage, and a feedback circuit for removing dark current, which is disabled at a small number of rotations in which the output of the operational amplifier is small and is enabled at a great number of rotations in which the output of the operational amplifier is great, and erroneous detection due to dark current is prevented.

According to a third aspect of the present invention, there is provided a misfire detecting circuit for an internal combustion engine, the misfire detecting circuit comprising: ion current detecting means for applying a positive polarity voltage to an ignition plug of a cylinder of an internal combustion engine and for detecting negative polarity ion-current of negative polarity caused by combustion; current/voltage conversion means for converting the ion current of negative polarity to a positive polarity voltage; and waveform shaping means for shaping the output of the current/voltage conversion means, wherein the ion current detecting means comprises an operational amplifier for converting ion current into a voltage, and a leak current compensating feedback circuit, connected between the output and the inverting input of the operational amplifier, for supplying feedback current corresponding to the leak current, and the waveform shaping means is formed of a leak-current filter circuit, connected to the output of the operational amplifier, for removing leak current, and the output of the filter circuit is used as the output of the misfire detecting circuit so that erroneous detection due to leak current is prevented.

According to a fourth aspect of the present invention, there is provided a misfire detecting circuit for an internal combustion engine, the misfire detecting circuit comprising: ion current detecting means for applying a positive polarity voltage to an ignition plug of a cylinder of an internal combustion engine and for detecting ion current of negative polarity caused by combustion; and current/voltage conversion means for converting the ion current of negative polarity to a positive polarity voltage, wherein the ion current detecting means comprises a capacitor, charged by electric current from outside, for holding the positive polarity voltage, a diode, connected between the electrode on the low potential side of the capacitor and the ground, for causing electric current to flow out from the capacitor, and a voltage limiting circuit for limiting the voltage of the capacitor, which circuit is formed of a transistor connected by emitter-grounded connection between the high potential side of the capacitor and the ground, and a voltage limiting element connected between the collector and the base of the transistor, and the transistor is turned on when a backward current is made to flow through the voltage limiting element by a backward voltage so that the power loss of the voltage limiting element is reduced.

According to a fifth aspect of the present invention, there is provided a misfire detecting circuit according to the fourth aspect of the present invention, wherein the voltage limiting circuit of the ion current detecting means further comprises a collector leak current prevention circuit for preventing leak current from flowing in from the capacitor to the collector of the transistor by always applying a positive polarity voltage to the emitter of the transistor.

According to a sixth aspect of the present invention, there is provided a misfire detecting circuit for an internal combustion engine, the misfire detecting circuit comprising: ion current detecting means for applying a positive polarity voltage to an ignition plug of a cylinder of an internal combustion engine and for detecting ion current of negative polarity caused by combustion; and current/voltage conversion means for converting the ion current of negative polarity to a positive polarity voltage, wherein the ion current detecting means comprises a capacitor, charged by electric current from outside, for holding the positive polarity voltage and for detecting an ion voltage for detecting ion current, a voltage limiting circuit for limiting the voltage of the capacitor, a first diode whose anode is connected to the electrode on the low potential side of the capacitor, for causing electric current to flow out from the capacitor, and a power-supply circuit for a circuit, which is formed of a capacitor for a circuit power supply, which capacitor is charged by electric current from outside in the same way as as in the capacitor for detecting ion current, is used to hold the positive polarity voltage, and a voltage limiting circuit for circuit power supply for limiting the voltage of the capacitor, and a circuit power supply is not required.

According to a seventh aspect of the present invention, there is provided a misfire detecting circuit further comprising output limiting means disposed on the output side of the misfire detecting circuit for limiting the output of the circuit when the voltage of the power supply circuit for a circuit falls below a predetermined value.

In the misfire detecting circuit in accordance with the first aspect to the present invention, since the current/voltage conversion means is formed of a circuit having a small input impedance, the time constant determined by stray capacitance and the resistance value of the circuit is decreased, and erroneous detection due to the influence by the stray capacitance is prevented without deteriorating current/voltage conversion characteristics (detection sensitivity).

In the misfire detecting circuit in accordance with the second aspect to the present invention, a feedback circuit for removing dark current is disposed in the current/voltage conversion means, which circuit is disabled at a small number of rotations in which output from the operational amplifier is small and it is enabled at a great number of rotations in which output from the operational amplifier is great. Thus, erroneous detection due to dark current is prevented, and the misfire detecting circuit is capable of responding to a wide range of rotations of the engine.

In the misfire detecting circuit in accordance with the third aspect to the present invention, a leak current compensating feedback circuit, connected between the output and the inverting input of the operational amplifier, for supplying the feedback current corresponding to the leak current, is disposed in the current/voltage conversion means, and a leak-current filter circuit, connected to the output of the operational amplifier, for removing the leak current is disposed in the waveform shaping means. Thus, erroneous detection due to the influence by leak current is prevented.

In the misfire detecting circuit in accordance with the fourth aspect to the present invention, a voltage limiting circuit for limiting the voltage of the capacitor of the ion current detecting means is formed of a transistor connected by emitter-grounded connection between the high potential side of the capacitor and the ground, and a voltage limiting element connected between the collector and the base of the transistor so that the transistor is turned on when a backward current flows through the voltage limiting element by a backward voltage, and thus the power loss of the voltage limiting element is reduced.

In the misfire detecting circuit in accordance with the fifth aspect to the present invention, a collector leak current prevention circuit for always applying a positive polarity voltage to the emitter of the transistor is further disposed in the voltage limiting circuit in accordance with the fourth aspect to the present invention so that leak current which flows from the capacitor to the collector of the transistor is prevented when ion current is detected.

In the misfire detecting circuit in accordance with the sixth aspect to the present invention, in addition to the capacitor for detecting ion current and a voltage limiting circuit, a power supply circuit for a circuit, formed of a capacitor for a circuit power supply, which capacitor is charged by electric current from outside in the same way as in the capacitor for detecting ion current, and formed of a voltage limiting circuit for a circuit power supply is disposed in the ion current detecting means. Thus, a circuit power supply is not required.

In the misfire detecting circuit in accordance with the seventh aspect to the present invention, output limiting means is further disposed on the output side of the misfire detecting circuit in accordance with the sixth aspect of the present invention, for limiting the output of the circuit when the voltage of the power supply circuit for a circuit falls below a predetermined value. Thus, erroneous detection due to the fact that the voltage of the power supply circuit for a circuit decreases is prevented.

DESCRIPTION OF THE PREFERRED EMBODIMENTS

Embodiments of the present invention will be explained below with reference to the accompanying drawings.

First Embodiment

Figure 1:
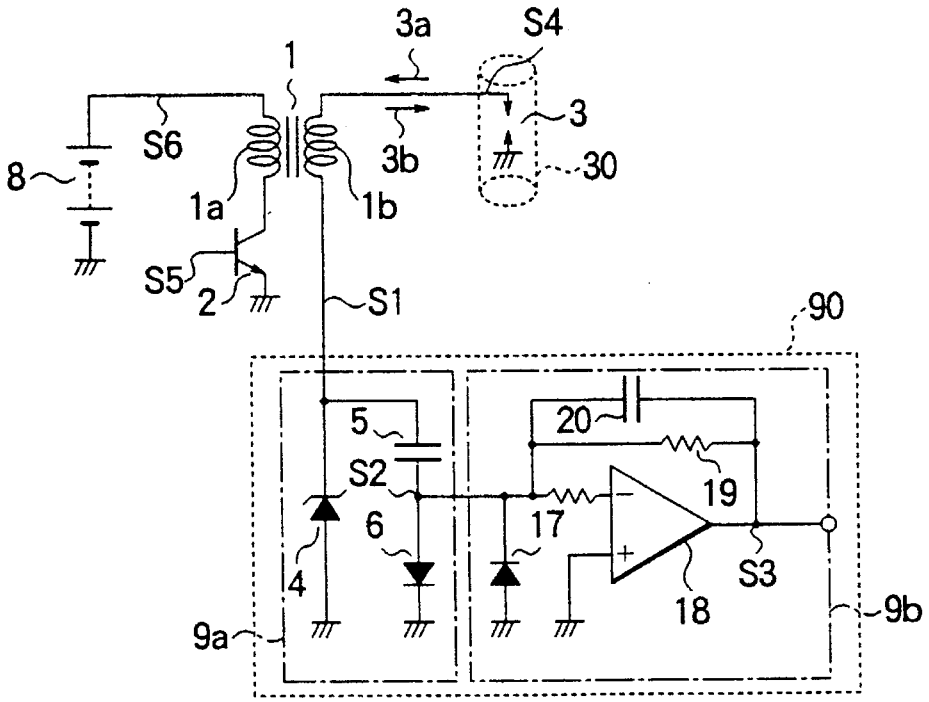
FIG. 1 is a circuit diagram illustrating a misfire detecting circuit in accordance with a first embodiment of the present invention.

Those components indicated by reference numerals 1 to 6, 8 and 30 in FIG. 1 are the same as those in the prior art.

Reference numeral 17 denotes a second diode whose anode is connected to the ground and whose cathode is connected to the connection point of the electrode on the low potential side of the capacitor 5 and the anode of the first diode 6. Reference numeral 18 denotes an operational amplifier whose inverting input is connected to the anode of the diode 6 and whose non-inverting input is connected to the ground, a feedback resistor 19 being connected between the inverting input and the output. Reference numeral 20 denotes a capacitor, connected between the inverting input and the output, for removing high-frequency noise. The Zener diode 4 constitutes the voltage limiting circuit of the capacitor 5 for detecting ion current.

Figure 2:
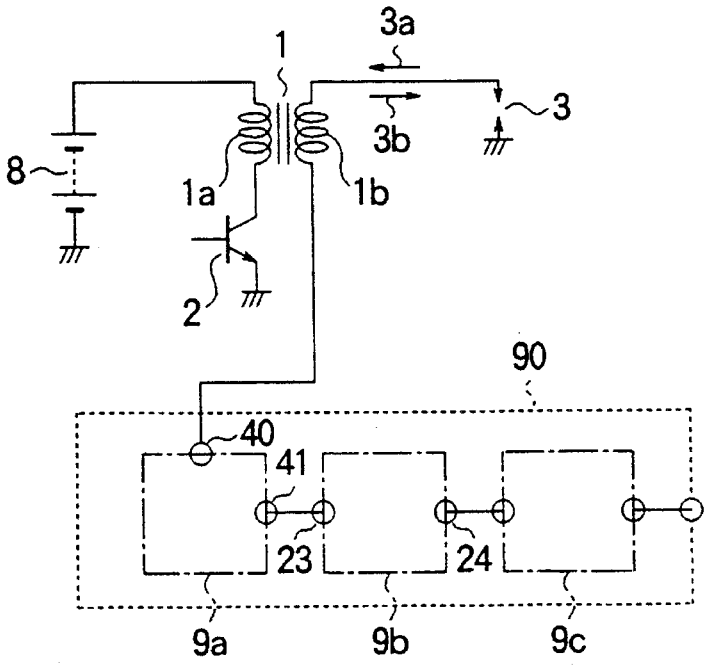
FIG. 2 is a function block diagram generally illustrating the construction of the misfire detecting circuit of each embodiment of the present invention.

FIG. 2 is a function block diagram generally illustrating the construction of the misfire detecting circuit of each embodiment of the present invention. In FIG. 2, reference numeral 90 denotes a misfire detecting circuit; reference numeral **9*a* denotes an ion current detection section for storing energy at the time of ignition in a capacitor and for detecting ion current on the basis of the charge stored in this capacitor; reference numeral 9*b* denotes a current/voltage conversion section; reference numeral 9*c* denotes a waveform shaping section for shaping noise of the voltage-converted signal; reference numerals 40 and 41 denote the input terminal and the output terminal of the ion current detection section 9*a*, respectively; and reference numerals 23 and 24 denote the input terminal and the output terminal of the current/voltage conversion section 9*b***, respectively.

Figure 3:
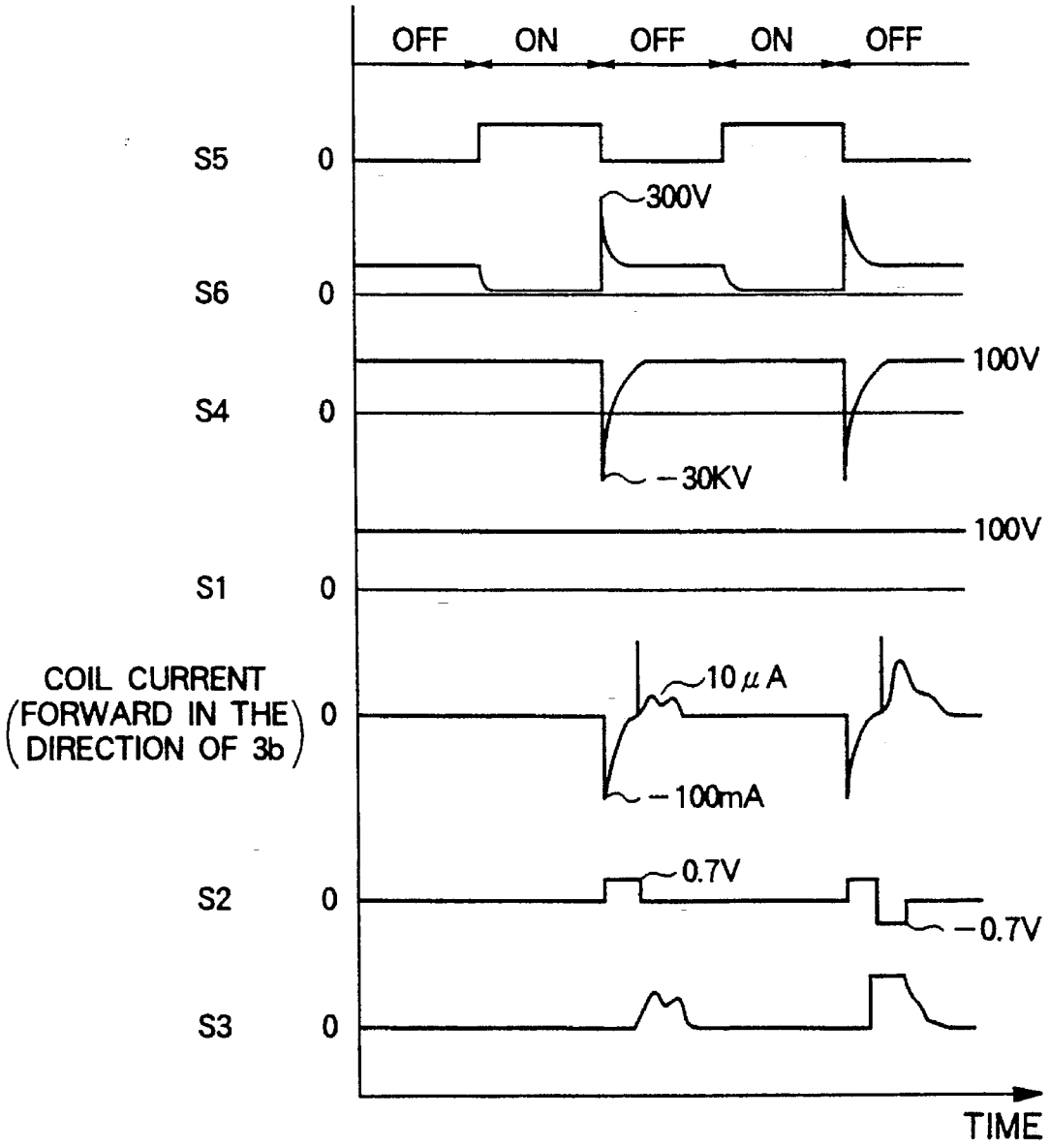
FIG. 3 is a wave chart illustrating the operation of the circuit of FIG. 1.

Next, the operation of the circuit of FIG. 1 will be explained below. The wave charts of the portions S1 to S6 of the circuit of FIG. 1 are shown in FIG. 3. S5 indicates the base potential of the transistor 2 for controlling the electric current on the primary side of the ignition coil 1. The transistor 2 is turned on during an ON period in which electric current is made to flow through the primary coil **1*a*** and is turned off during an OFF period in which the flow of electric current is stopped.

When the transistor 2 changes its state from on to off, the voltage of S6 increases to approximately 300 V (volts) due to the counter electromotive force of the coil. This voltage is equal to the collector-emitter voltage resistance of the transistor 2. The high voltage generated at S6 is multiplied in accordance with the coil winding ratio of the primary coil **1*a* to that of the secondary coil 1*b*, the voltage reaches about 30 KV (kilovolt) on the secondary side, and a spark is generated in the ignition plug 3. At this instant, a maximum of approximately 100 mA (milliampere) of the electric current flowing to the secondary side of the ignition coil 1 flows in the direction of the arrow 3*b*. Thereafter, when the coil current decreases to zero, the voltage of S4 of the ignition plug 3 becomes the voltage held by the capacitor 5, and ion current flows in the direction of the arrow 3*b***.

The voltage S2 is a voltage of the inverting input of the inverted amplifier formed of an operational amplifier 18 and a resistor 19. When the operational amplifier 18 is normally operating, the voltage is equal to the non-inverting input voltage which is zero volt. There are two types of cases in which the operational amplifier is not normally operating: one case in which the electric current flows in the direction of the arrow **3*b*, and another case in which the electric current in the direction of the arrow 3*b* is too large and the output of the operational amplifier is saturated. When the electric current flows in the direction of the arrow 3*b*, the voltage of S2 becomes the forward voltage (0.7 V) of the first diode 6. When the electric current in the direction of the arrow 3*b* is large and the output of the operational amplifier is saturated, a second diode 17 conducts, and the voltage of the S2 decreases by an amount corresponding to the forward voltage. When the operational amplifier is normally operating, the ion current develops as a voltage drop of the feedback resistor 19**, is converted into a grounding reference signal, and this signal is output.

With such a circuit arrangement, as can be seen from the waveform of the voltage at S2, voltage variation with respect to the current variation decreases on the low potential side of the capacitor 5. If the operational amplifier 18 is normally operating, apparently the voltage of S2 becomes constant, and even if the operational amplifier 18 is not normally operating, it becomes constant at the forward voltage of the diode. That is, the impedance of the detection circuit when seen from the point of S2 is exceedingly low. Owing to this effect, it is possible to decrease the impedance of the circuit and resultingly to considerably increase the tolerance to malfunctions caused by the stray capacitance and the impedance of the circuit without deteriorating the current/voltage conversion characteristics (detection sensitivity) of the ion current.

Although conventional ion detection circuits malfunction when the stray capacitance is approximately 200 pF (picofarad), the circuit of FIG. 1 is able to operate at a capacity of approximately 2,000 pF while maintaining the same detection sensitivity. Thus, malfunctions caused by stray capacitance are reduced.

Figure 20:
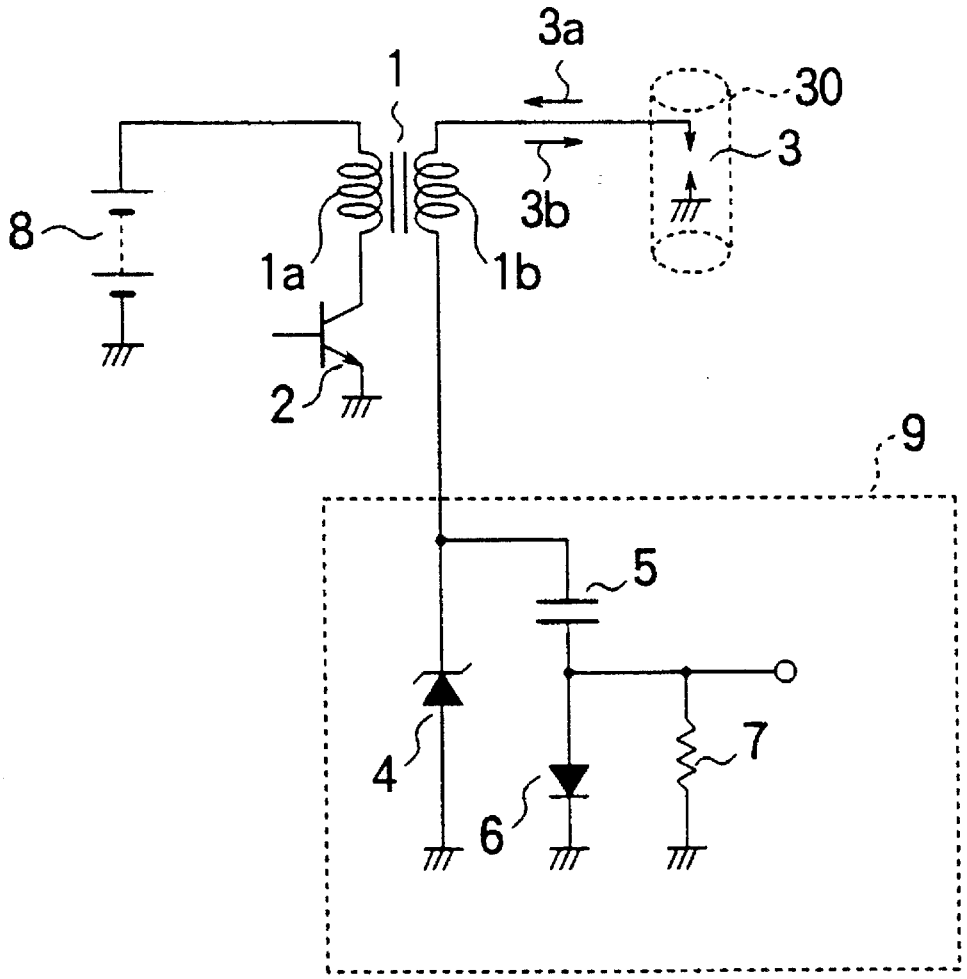
FIG. 20 is a circuit diagram illustrating a conventional misfire detecting circuit.

Furthermore, the conventional circuit of FIG. 20 generates a negative voltage such that the diode 6, the resistor 7 and the like cannot be mounted in a monolithic integrated circuit operable using a single power supply. In the arrangement of FIG. 1, the diode 6 and the current/voltage conversion section 9*b* can be integrated into a monolithic integrated circuit having a single power supply. Thus, the misfire detecting circuit 90 can be made compact.

The circuit arrangement of FIG. 1 not only operates well when exposed to stray capacitance, but also avoids the adverse effects of dark current and leak current, by merely adding a very simple circuit as described hereinafter.

Figure 4:
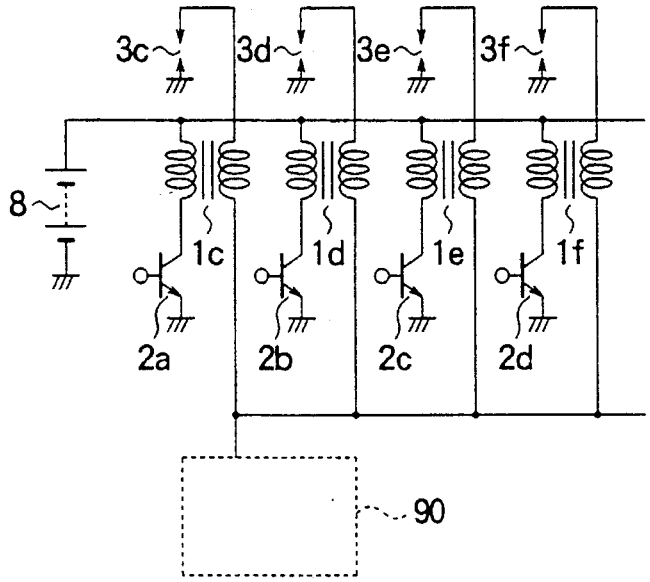
FIG. 4 is a circuit diagram illustrating an example of the connection between the misfire detecting circuit of the present invention and an ignition system of the low voltage distribution of the internal combustion engine.
Figure 5:
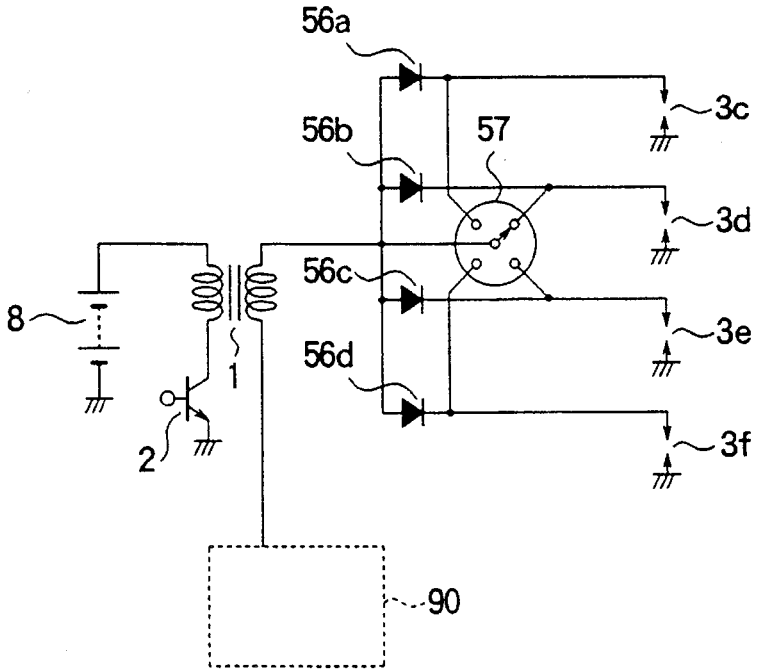
FIG. 5 is a circuit diagram illustrating an example of the connection between the misfire detecting circuit of the present invention and an ignition system of the high voltage distribution of the internal combustion engine.

FIGS. 4 and 5 illustrate an example of the connection between the misfire detecting circuit 90 and the ignition system of the internal combustion engine. FIG. 4 illustrates a connection example with a low voltage distribution to the internal combustion engine, and FIG. 5 illustrates a connection example with a high voltage distribution of the internal combustion engine. Referring to FIG. 4, reference numerals 3*c* to 3*f* denote ignition plugs for four cylinders; reference numerals 1*c* to 1*f* denote the respective ignition coils of these ignition plugs; and reference numerals 2*a* to 2*d* denote transistors for switching the electric current on the primary side of the ignition coils 1*c* to 1*f*, respectively. Referring to FIG. 5, reference numerals 56*a* to 56*d* denote diodes for detecting ion current; and reference numeral 57 denotes a distributor.

FIGS. 4 and 5 show an example in which the misfire detecting circuit is applied to a four-cylinder engine. FIGS. 4 and 5 also illustrate that it is possible to perform ion current detection for four cylinders using one misfire detecting circuit 90. An engine having five or more cylinders has a shorter combustion cycle. Accordingly, the cylinders may be grouped to increase the combustion cycle. In this case, two or more misfire detecting circuits are used.

Figure 6:
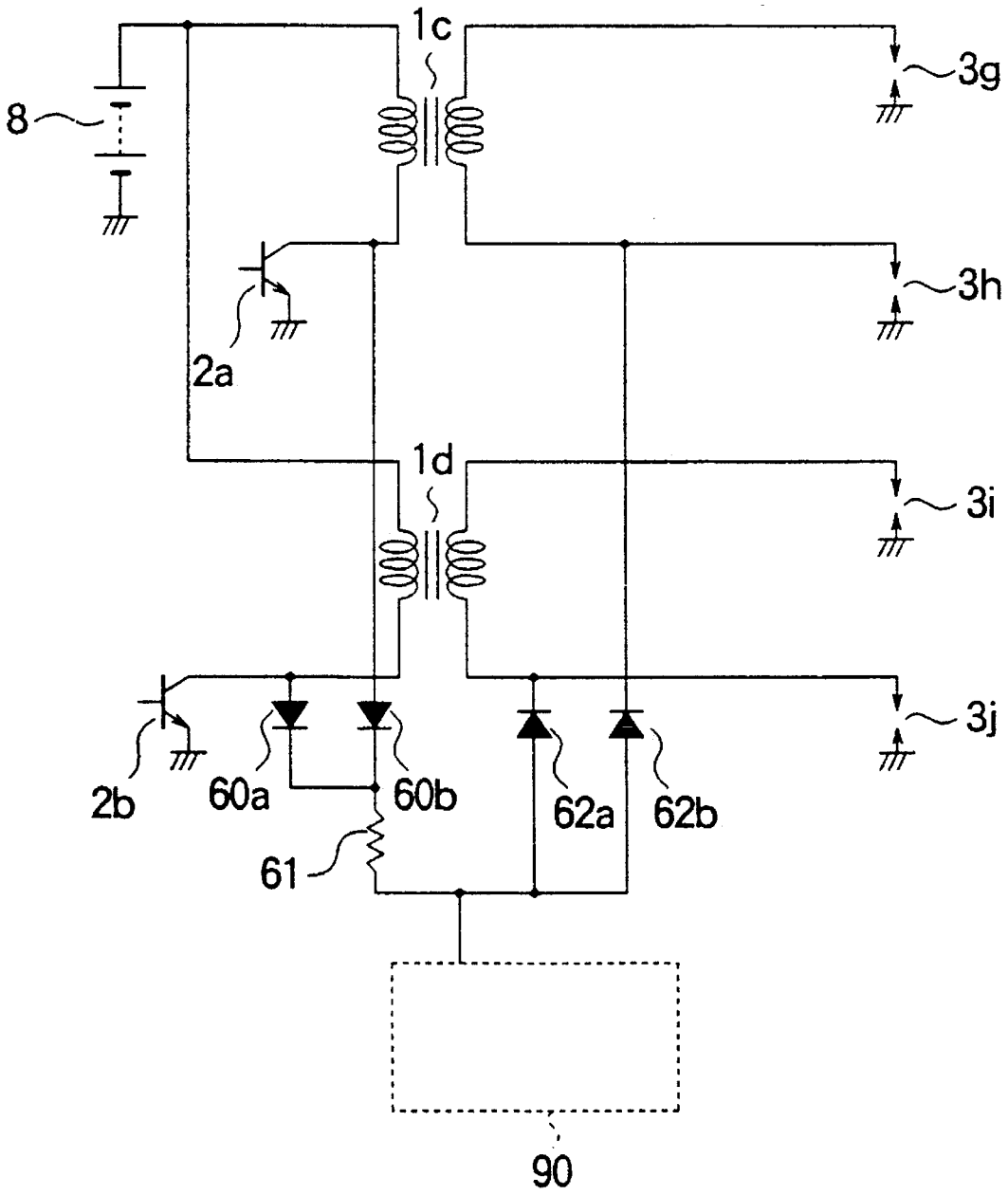
FIG. 6 is a circuit diagram illustrating an example of the connection in which the misfire detecting circuit of the present invention receives charge current for a capacitor from the primary side of the ignition coil.

FIG. 6 shows an example in which the misfire detecting circuit is connected to the ignition system having a simultaneous ignition of two cylinders. An electric spark is generated on both poles of the secondary side of the ignition coil using a high voltage generated across the two poles of the secondary side of the ignition coil. Referring to FIG. 6, reference numeral 3*g* and 3*i* each denote an ignition plug from which an electric spark of a negative voltage is generated, and reference numeral 3*h* and 3*j* each denote an ignition plug from which an electric spark of a positive voltage is generated. High voltage-resistant diodes 62*a* and 62*b* detect ion current at the ignition plugs 3*h* and 3*j*, respectively.

In the case of FIG. 6, a positive polarity bias voltage is supplied to the capacitor 5 (see FIG. 1) of the misfire detecting circuit 90 from the primary side of the ignition coil via the high-voltage diodes 60*a* and 60*b*, and a resistor 61 rather than from the secondary side of the ignition coil. As described above, the misfire detecting circuit 90 may be operated by supplying electric current thereto from the primary side of the ignition coil depending upon the distribution system. That is, the charging of the capacitor 5 is not limited to the supply of electric current from the secondary side of the ignition coil, but may be performed from an electric current source capable of generating a voltage higher than the limiting voltage.

Examples of connections between the misfire detecting circuit 90 and the ignition system shown in FIGS. 4 to 6 are not limited to the first embodiment of the misfire detection circuit 90, and are equally applicable to the misfire detecting of the embodiments described below.

Second Embodiment

Figure 7:
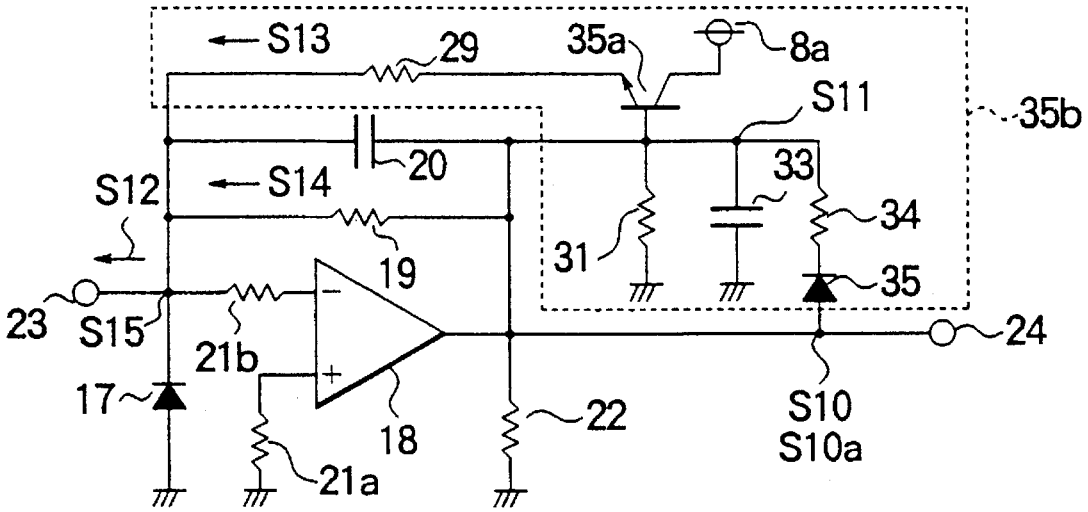
FIG. 7 is a circuit diagram illustrating current/voltage conversion means of a misfire detecting circuit in accordance with a second embodiment of the present invention.

FIG. 7 is a circuit diagram illustrating the current/voltage conversion section 9*b* (see FIG. 2) of the misfire detecting circuit 90 in accordance with a second embodiment of the present invention. The circuit for preventing erroneous detection of ion current due to the influence by dark current of the second embodiment is disposed in the current/voltage conversion section 9*b*.

Those components 18 to 20 in FIG. 7 are the same as those in FIG. 1. Reference numeral 21*a* and 21*b* denote input resistors of the operational amplifier 18; reference numeral 22 denotes an output resistor of the operational amplifier 18, which is used to lower the voltage level when the output is at an L level; reference numeral 35*b* denotes a feedback circuit for removing dark current; reference numeral 35 denotes a diode; reference numerals 29, 31 and 34 denote resistors; reference numeral 33 denotes a capacitor; reference numeral 35*a* denotes an NPN type transistor; and reference numeral 8*a* denotes a power supply.

Figure 8:
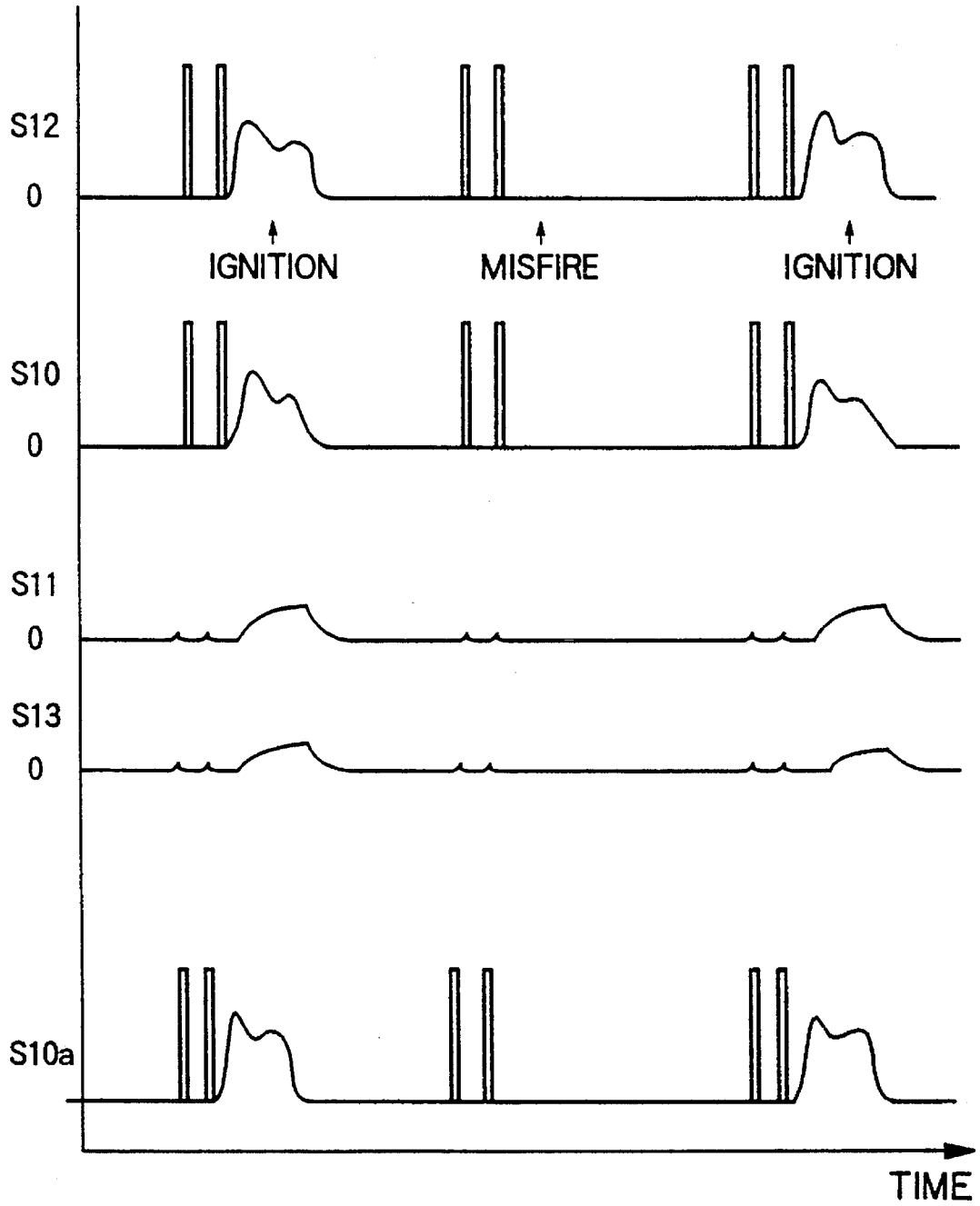
FIG. 8 is a wave chart illustrating the operation of the circuit of FIG. 7 at a small number of rotations.
Figure 9:
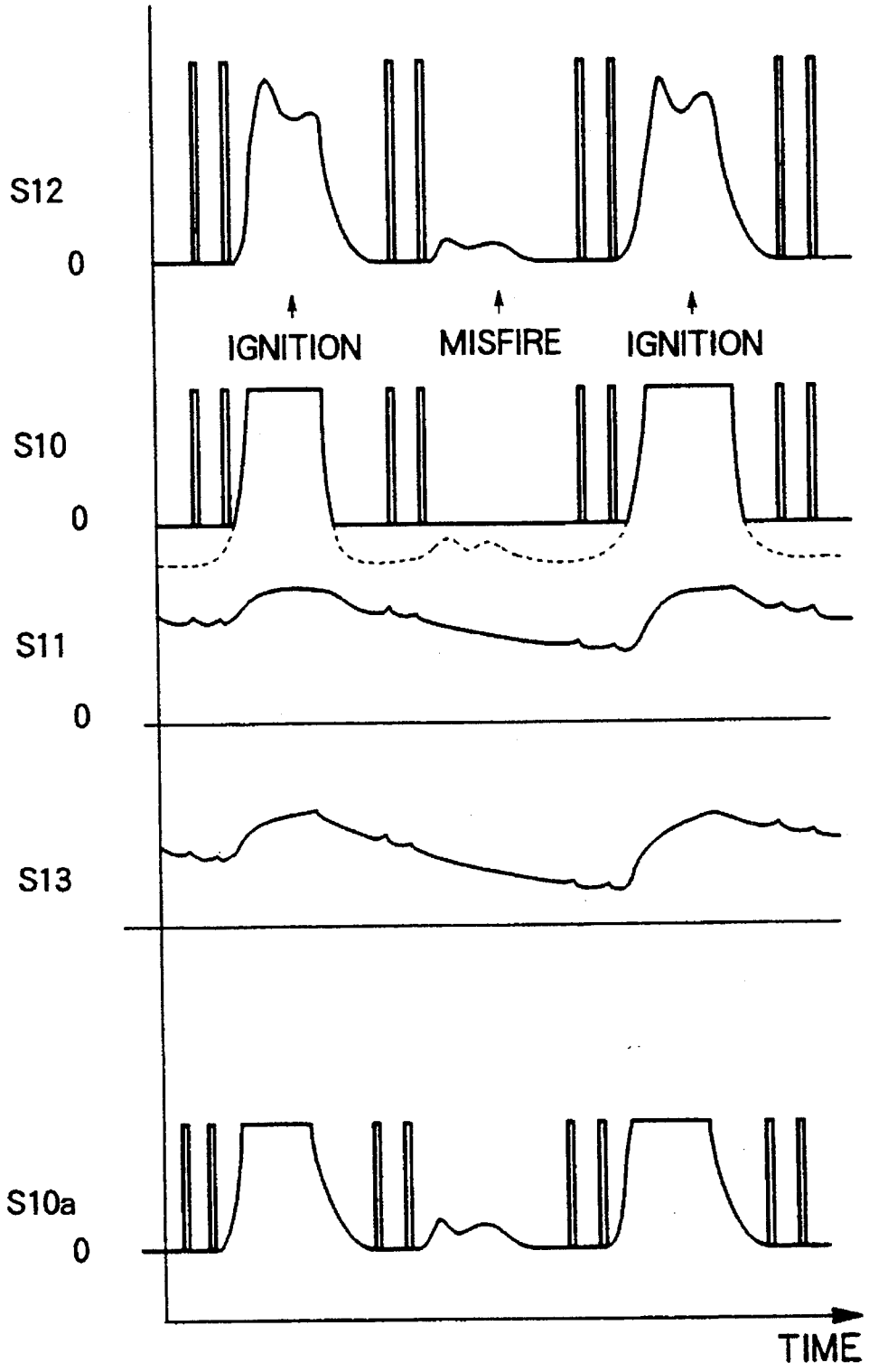
FIG. 9 is a wave chart illustrating the operation of the circuit of FIG. 7 at a great number of rotations.

FIGS. 8 and 9 show the wave charts of portions S10 to S13 of the circuit of FIG. 7. FIG. 9 shows the wave forms generated when the engine is operated at high rotational speeds. In FIG. 9, S12 indicates ion current, and the direction of the arrow in FIG. 7 is assumed to be forward. S13 and S14 each indicate electric current of the feedback circuit. S10 indicates the output of the current/voltage conversion section 9*b*. S10*a* indicates the output of the current/voltage conversion section 9*b* when the feedback circuit 35*b* for removing dark current is not included. S11 indicates the voltage of a capacitor 33.

As shown in FIG. 8, when the number of rotations of the engine is small, the combustion cycle increases. The absolute value of the ion current decreases in response to the decrease in the number of rotations. By contrast, as shown in FIG. 9, when the combustion cycle decreases with increasing rotational speeds, the absolute value of the ion current increases.

Next, the operation of the circuit will be explained with reference to the figures. If it is assumed that ion current S12 flows and feedback current S13 is zero, then the ion current S12 is equal to feedback current S14. Since the electrical potential of S15 on the inverting input side of the operational amplifier 18 approaches a ground potential, the output of the current/voltage conversion section 9*b* is determined by the product of the feedback current S14 and the feedback resistor 19. However, if the feedback current S13 of the dark current removing feedback circuit 35*b* is positive, the feedback current S14 becomes a current such that the feedback current S13 is removed from the ion current S12, and as a result the output voltage decreases. The value of the feedback current S13 depends upon the values of the voltage S11 stored in the capacitor 33 and a resistor 29. The feedback current S13 also increases in response to the increase of S11. When the output S10 increases, the electrical potential of S11 increases because the capacitor 33 is charged through a resistor 34. That is, a negative feedback circuit is formed such that when the electrical potential of the output S10 increases, S13 increases and as a result the electrical potential of the output S10 decreases.

The capacitor 33, the resistor 29, 31 and 34, and the like are respectively set so that the dark current removing feedback circuit 35*b* is disabled at low operational speeds and enabled at high operational speeds. As shown in FIG. 8, when the output and number of rotations are small, the dark current at the time of a misfire is also small. Therefore, the effect of the circuit of the dark current removing feedback circuit 35*b* may be small. As shown in FIG. 9, at high operational speeds, the output signal and the dark current are large if the dark current removing feedback circuit 35*b* is not disposed, and a signal due to the dark current is generated in the output (S10) when a misfire occurs. However, if the dark current removing feedback circuit 35*b* is included, as seen in the waveform of S13, the dark current is not detected because of the feedback current 513. In the waveform of S10, the dark current is removed.

As a result, it becomes possible to accurately detect a misfire for a wide range of rotational speeds of the engine.

Third Embodiment

Figure 10:
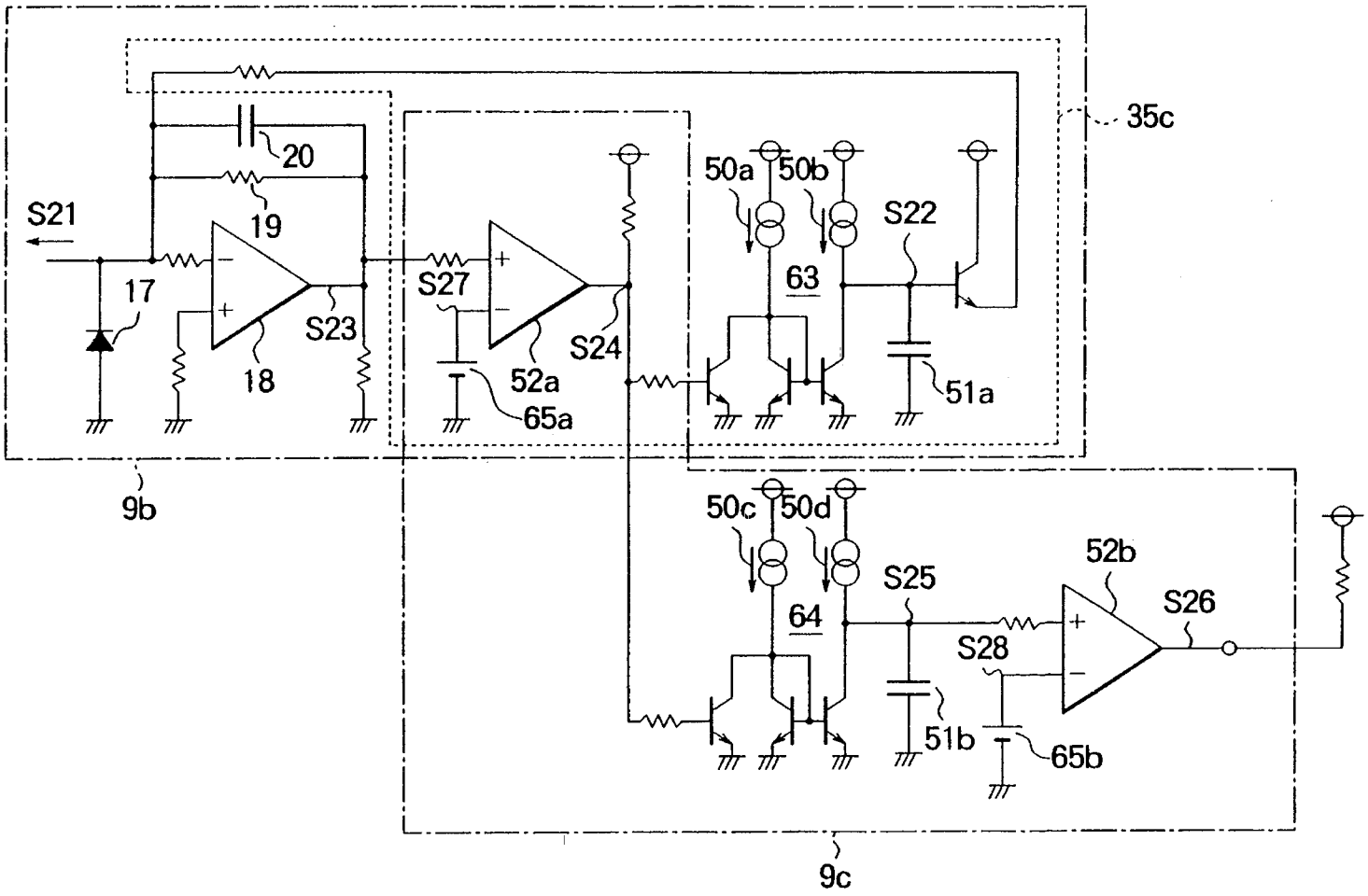
FIG. 10 is a circuit diagram illustrating current/voltage conversion means and waveform shaping means in accordance with a third embodiment of the present invention.

FIG. 10 is a circuit diagram illustrating the current/voltage conversion section 9*b* and the waveform shaping section 9*c* (see FIG. 2) of the misfire detecting circuit 90 in accordance with a third embodiment of the present invention. The circuit of the third embodiment further comprises a waveform shaping circuit for preventing erroneous detection of ion current due to the influence of leakage currents.

Figure 11:
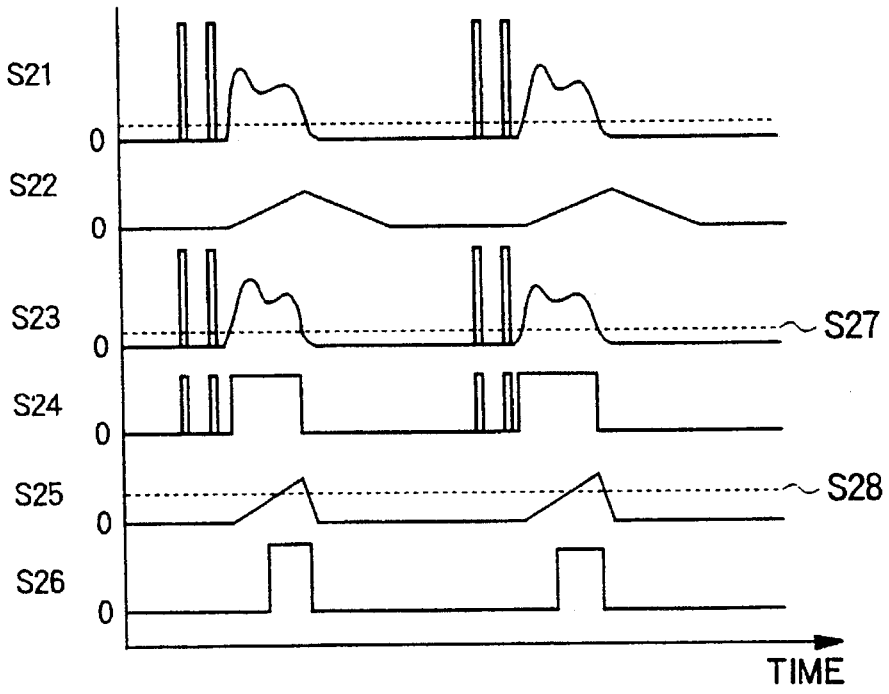
FIG. 11 is a wave chart illustrating the operation of the circuit of FIG. 10 when there is no leak current.
Figure 12:
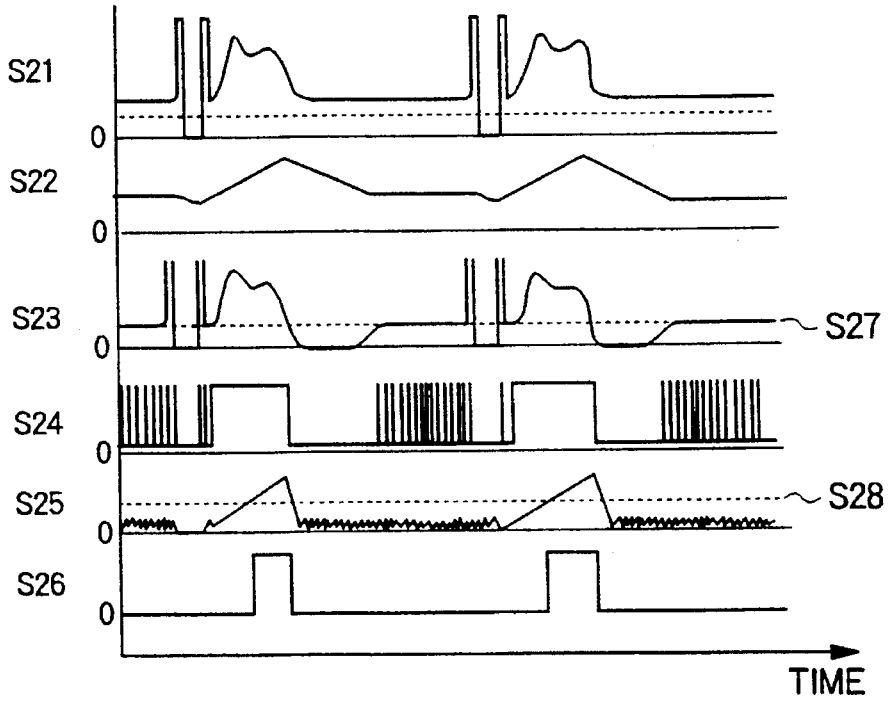
FIG. 12 is a wave chart illustrating the operation of the circuit of FIG. 10 when there is leak current.

Referring to FIG. 10, reference numeral 9*b* denotes an ion current detection section 9*b;* and reference numeral 9*c* denotes a waveform shaping section. FIGS. 11 and 12 show wave charts of portions S21 to S26 of the circuit of FIG. 10. FIG. 11 is a wave chart when there is no leak current, and FIG. 12 is a wave chart when there is leak current.

In the current/voltage conversion section 9*b* of FIG. 10, those components 17 to 20 are the same as those in the above embodiments. A leak current compensating feedback circuit 35*c* is connected to the portion where this current is converted into a voltage. The leak current compensating feedback circuit 35*c* comprises a comparator 52*a* for comparing the output of the operational amplifier 18 with a reference voltage source 65*a*, a capacitor 51*a* and a constant current charging/discharging circuit 63 of the capacitor 51*a*. The waveform shaping section 9*c* comprises a comparator 52*a* for comparing the output of the operational amplifier 18 with a reference voltage source 65*a*, a capacitor 51*b* and a constant current charging/discharging circuit 64 of the capacitor 51*b*, and a leak current filter circuit formed of a comparator 52*a* for comparing the voltage of the capacitor 51*b* with a reference voltage voltage source 65*b*. That is, the comparator 52*a* is shared by the current/voltage conversion section 9*b* and the waveform shaping section 9*c*.

If a leakage current $I_{LK}$ [A] (ampere) occurs between the ignition plug and the ground, a relation $R_{LK} \times I_{LK} = V_{IB}$ is satisfied where a bias voltage for detecting ion current is $V_{IB}$ (volt) and the resistance value of the leak (the resistance value due to the gap between the ignition plug and the ground when electric current flows between the ignition plug and the ground) is $R_{LK}$ [Ω] (ohm). If the capacitance value of the capacitor 5 is denoted as $C_{IB}$ [F] (farad), the leak current exhibits a discharging characteristic determined by the time constant of $C_{IB} \times R_{LK}$ [sec], and this current can be regarded as DC current if it is sufficiently large with respect to the combustion cycle T [sec]. As can be seen by comparing the waveforms of S21 of FIGS. 11 and 12, it is observed that the DC components of the ion current waveform increase.

When the ion current is converted from current into voltage and compared with a predetermined threshold value, and when the leak current shown in FIG. 12 is contained, there is the possibility that erroneous detection may be performed due to the influence by the leak current regardless of the presence or absence of the ion current.

The leak current compensating feedback circuit 35*c* of FIG. 10 is added to the circuit of the first embodiment shown in FIG. 1 as described above in order to realize the current/voltage conversion section 9*b*. The leak current compensating feedback circuit 35*c* is designed to effect control so that the output of the operational amplifier 18 will not exceed the threshold voltage determined by a voltage S27 of the reference voltage source 65*a*.

As shown in FIG. 11, when ion current is generated, S23 which is an output from the operational amplifier 18 increases and exceeds the threshold value determined by the voltage S27 of the reference voltage source 65*a*, a voltage S22 of the capacitor 51*a* increases, and the feedback current increases. However, it is important that the control speed (through rate) by the feedback circuit 35*c* be slower than the change of the ion current with time, and detection is performed in such a way as to follow the leak current (having primarily DC components) and not the ion current. As shown at S24 of FIG. 11, a voltage S24 which is the output of the comparator 52*a* reaches a H level while the ion current is generated, and as a result a voltage S25 of the capacitor 51*b* of the waveform shaping section 9*c* increases. When the voltage S25 exceeds a voltage S28 of the reference voltage source 65*b*, an output S26 of a comparator 52*b* increases and reaches a H level. The waveform shaping section 9*c* filters ion current having a period greater than a fixed period to remove components of the ion current caused by the leakage current.

When leakage current is present, the DC voltage components of the voltage S22 of the capacitor 51*a* of the feedback circuit 35*c* increases as shown in the waveform S22 of FIG. 12, and the feedback circuit 35*c* supplies the electric current for the leakage current. When the leakage current is present and the ion current is not present, the voltage S23 which is an output of the operational amplifier 18 is equal to S27, and the voltage S24 output from comparator 52 is in an oscillating state. If the duty in an oscillating state is equal to the ratio of the charging current of the capacitor 51*a* to the discharging current thereof and if the ratio of the charging current of the capacitor 51*a* to the discharging current thereof is set in such a way that the discharging current is greater than that of the capacitor 51*a*, the above state in which the leak current is compensated can be determined as a state in which there is no ion current.

If the current of a constant current source 50*a* is increased more than the current of a constant current source 50*b* in the constant current charging/discharging circuit 63, the discharging current increases and discharging time decreases. By contrast, if the current of the constant current source 50*a* decreases to a value less than the current of the constant current source 50*b*, the charging current increases and consequently, the charging time is reduced. Similarly, if the current of a constant current source 50*c* is increased more than the current of the constant current source 50*d*, discharging current increases and the discharging time decreases. By contrast, if the current of the constant current source 50*c* decreases to a value less than the current of the constant current source 50*d*, the charging current increases and charging time decreases.

Also, if the setting of the discharging current of the capacitor 51*a* and the capacitor capacitance is adjusted, the same advantage as in the second embodiment can be obtained.

Although in the circuit of FIG. 10 the comparator 52*a* is shared by the current/voltage conversion section 9*b* and the waveform shaping section 9*c*, a comparator for the current/voltage conversion section 9*b* and that for the waveform shaping section 9*c* may be disposed separately on the output side of the operational amplifier 18.

Fourth Embodiment

Figure 13:
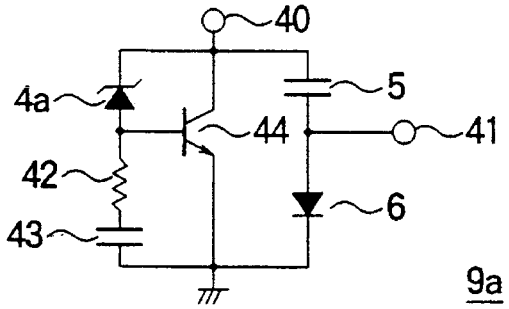
FIG. 13 is a circuit diagram illustrating an ion current detection section of a misfire detecting circuit in accordance with a fourth embodiment of the present invention.

FIG. 13 is a circuit diagram illustrating the ion current detection section 9*a* (see FIG. 2) of the misfire detecting circuit 90 in accordance with a fourth embodiment of the present invention. Referring to FIG. 13, reference numeral 44 denotes an NPN type transistor connected by emitter-grounded connection between the electrode on the high potential side of the capacitor 5 and the ground; reference numeral 4*a* denotes a Zener diode which is a voltage limiting element, which diode, together with the NPN type transistor, constitutes a voltage limiting circuit for limiting the charging voltage of the capacitor 5. A resistor 42 and a capacitor 43 constitute a circuit for preventing oscillation for improving stability of the voltage limitation function.

When limiting the charging voltage, a higher limiting voltage value increases the power loss which occurs when the capacitor is charged. Therefore, it is necessary to use an element having a power rating sufficient to withstand the heat generated from the power loss. However, a problem arises in that it is difficult to obtain a diode having a sufficiently large power rating.

The circuit of FIG. 13 realizes a comparable voltage limiting function using a transistor. The transistor 44 has a collector-emitter voltage resistance higher than the voltage resistance of the Zener diode 4*a*, the Zener diode 4*a* being connected between the collector and the emitter. As a result, if a backward voltage applied to the Zener diode 4*a* exceeds the resistance voltage thereof, a backward current flows, causing the transistor 44 to be turned on so that electric current flows from the collector of the transistor 44 to the emitter thereof. Thus, power loss which occurs in the Zener diode 4*a* is reduced. As a result, a power rating of the Zener diode 4*a* may be reduced.

The circuit for preventing oscillation includes the resistor 42 and the capacitor 43, and depends upon the characteristics of the Zener diode 4*a* and the transistor 44. This circuit may be omitted where appropriate.

Fifth Embodiment

Figure 14:
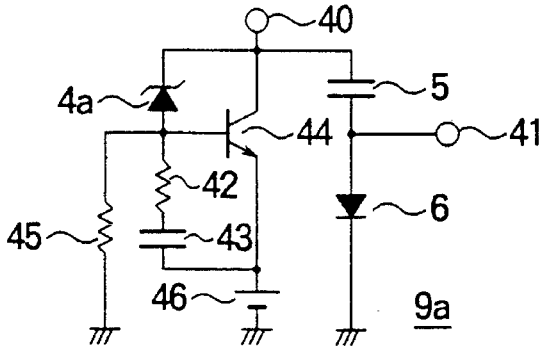
FIG. 14 is a circuit diagram illustrating an ion current detection section of a misfire detecting circuit in accordance with a fifth embodiment of the present invention.

FIG. 14 is a circuit diagram illustrating the ion current detection section 9*a* (see FIG. 2) of the misfire detecting circuit 90 in accordance with a fifth embodiment of the present invention. This circuit, in addition to the circuit of the fourth embodiment in FIG. 13, is a circuit in which the leakage current between the collector and the emitter of the transistor 44 is reduced. The emitter of the transistor 44 is always biased by a positive voltage using a power supply 46, and by grounding the base via a resistor 45. In this way, the section between the base and the emitter is reverse biased so that the leak current of the collector is reduced. That is, the leakage current flowing out from the charged capacitor 5 to the collector of the transistor 44 is reduced to enable the detection of the ion current.

The power supply 46 and the resistor 45 constitute a collector leakage current prevention circuit. The transistor 44 may be a Darlington connected transistor (not shown).

Sixth Embodiment

Figure 15:
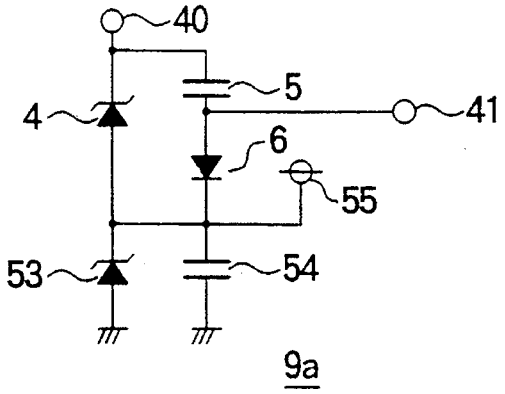
FIG. 15 is a circuit diagram illustrating an ion current detection section of a misfire detecting circuit in accordance with a sixth embodiment of the present invention.

FIG. 15 is a circuit diagram illustrating the ion current detection section 9*a* (see FIG. 2) of the misfire detecting circuit 90 in accordance with a sixth embodiment of the present invention. Although in each of the above-described embodiments the cathode of the diode 6 is grounded, the cathode may be at other electrical potentials, for example, the cathode may be connected to a power supply or the like.

The circuit of FIG. 15 does not require a power supply for driving the misfire detecting circuit by varying the connection of the diode 6 and is capable of detecting ion current with a high degree of accuracy. The capacitor 5 and the Zener diode 4 operate to facilitate detection of the ion current. A capacitor 54 operates in conjunction with Zener diode 53 to provide a voltage limited power source. The capacitor 54 is charged by electric current generated, for example, at the time of ignition in the same way as in the capacitor 5 for detecting ion current, and the above voltage is limited by the Zener diode 53.

The capacitor 54 and the Zener diode 53 constitute a power supply circuit.

Figure 16:
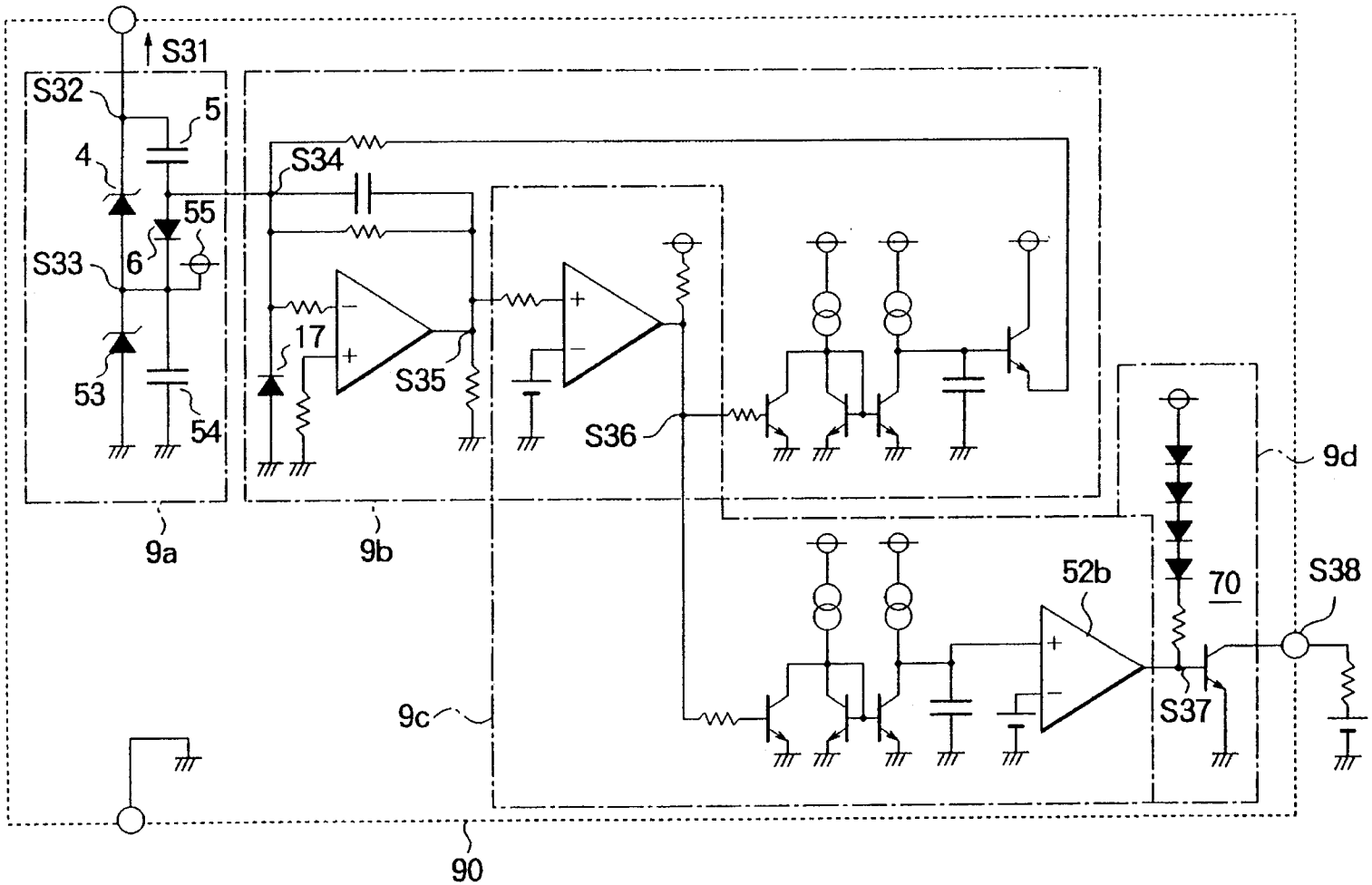
FIG. 16 is a circuit diagram illustrating an example of the whole misfire detecting circuit having the circuit of FIG. 15.
Figure 17:
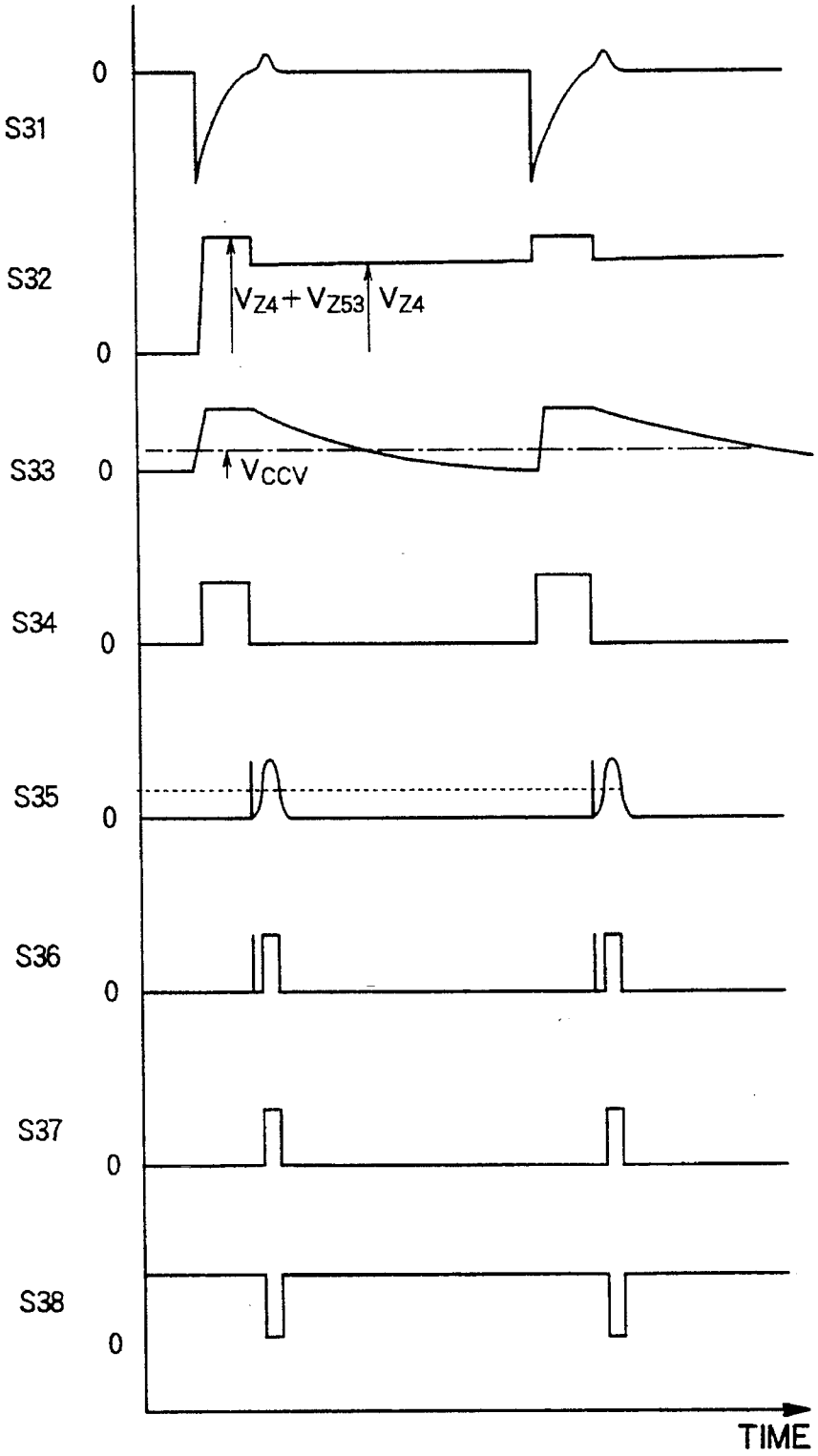
FIG. 17 is a wave chart illustrating the operation of the circuit of FIG. 16.

FIG. 16 is a circuit diagram illustrating an example of the misfire detecting circuit 90 using the ion current detection section 9*a* shown in FIG. 15. FIG. 17 is a wave chart illustrating portions S31 to S38 of the circuit of FIG. 16. In the circuit of FIG. 16, the voltage for detecting ion current and the voltage for driving the misfire detecting circuit 90 are charged in the capacitors, respectively, by using current generated at the time of ignition, and after the ignition is completed, the circuit is made to operate for a fixed period of time so that ion current is detected. The current/voltage conversion section 9*b* and the waveform shaping section 9*c* are the same as those of the circuit of FIG. 10. As a countermeasure for a case in which the voltage of the capacitor 54 for a circuit power supply decreases due to discharging, a binary output circuit 70 is disposed further in this circuit, which output circuit constitutes an output limiting section 9*d* whereas the output when the voltage of the power supply circuit for a circuit is below a predetermined voltage is opposite to the output when the ion voltage is detected.

In FIG. 17, S31 indicates input electric current of the misfire detecting circuit. The negative current is a current in a direction flowing into the circuit, which is generated at the time of ignition, and the positive current is a current in a direction flowing out from the circuit, which is caused by ion current.

The capacitors 5 and 54 are charged by the negative current generated at the time of ignition, and the voltages thereof are limited by the Zener diodes 4 and 53, respectively. If the Zener voltages of the Zener diodes 4 and 53 are denoted as $V_{Z4}$ and $V_{Z53}$, respectively, the relation $V_{Z4}+V_{Z53}$ is satisfied at S32. The voltage at S34 is a voltage higher by the forward voltage of the diode 6 than that at S33 when the capacitor 5 is charged. However, when the charging of the capacitor is completed, it becomes zero volt or lower than the zero volt by the forward voltage of the diode 17 by the operation of the current/voltage conversion section 9*b*.

Therefore, the voltage of S32 is $V_{Z4}+V_{Z53}$ at the time of ignition, and becomes $V_{Z4}$ when ion current is detected. The voltage at S33 is a voltage held by the capacitor 54, which becomes a maximum of $V_{Z53}$ at the time of ignition, and decreases due to the consumed current of the circuit when ion current is detected. If the minimum operating power voltage of the misfire detecting circuit 90 is denoted as $V_{CCV}$, the capacitor 54 and the circuit consumption current are set by assuming that the ion current is detected in a period when the voltage of the S33 is higher than $V_{CCV}$.

For the current/voltage conversion section 9*b* and the waveform shaping section 9*c*, the circuits of the first to third embodiments or other comparable circuits may be used. However, as for the circuit output, it is preferable that the output when the circuit power-supply voltage of the power-supply circuit for a circuit (the voltage 55 in FIG. 15) is $V_{CCV}$ or less be equal to the output when ion current is not detected and be an opposite output when ion current is detected. It is also preferable that the output limiting section 9*d* shown in FIG. 16 be disposed on the output side of the misfire detecting circuit 90. Needless to say, the voltage of each reference voltage source in the circuit is respectively generated on the basis of the voltage of the power-supply circuit for the circuit.

With the above-described construction, since the power supply for driving the circuit becomes unnecessary. Consequently, the cost is reduced by reducing the wire harness and the degree of freedom of the arrangement of the apparatus is increased. Further, countermeasures for surges superimposed on the power line and for erroneous reverse polarity battery connections, unnecessary, and hence reliability is improved. Further, since the circuit is a circuit which operates by electric current which flows at the time of ignition, it does not operate erroneously at standby, and thus the reliability of the system is further improved.

Figure 18:
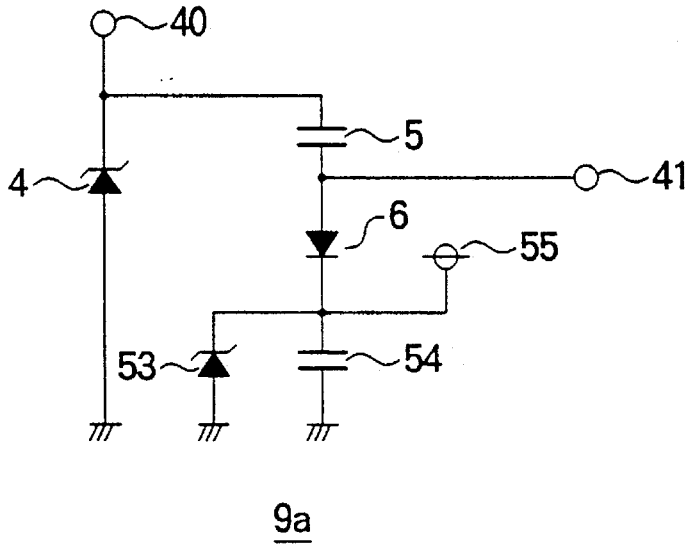
FIG. 18 is a circuit diagram illustrating a modification of the circuit of FIG. 15.
Figure 19:
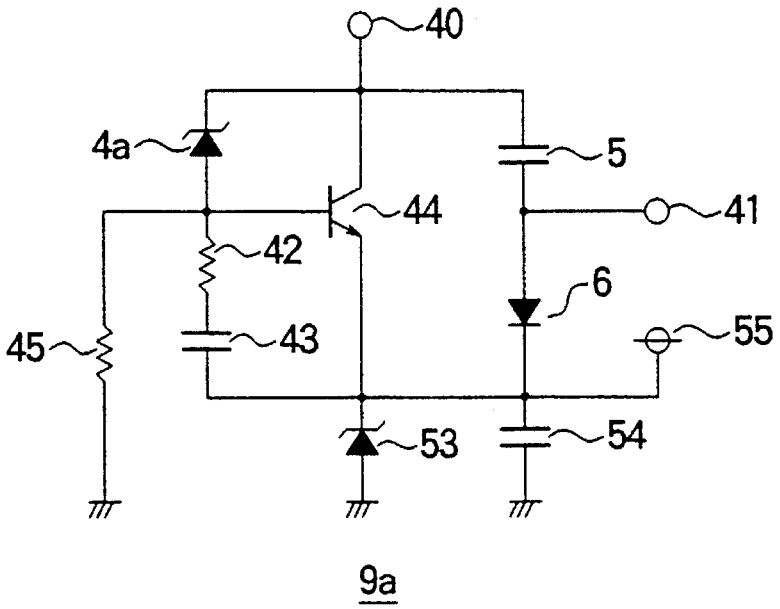
FIG. 19 is a circuit diagram illustrating another modification of the circuit of FIG. 15.

The circuit of the ion current detection section 9*a* of FIG. 15 may be such that the diodes 4 and 53 are separately connected as shown in FIG. 18. The Zener diode 4, as shown in FIG. 19, may be changed to a circuit using the transistor 44 shown in FIG. 14. Further, the Zener diode 53 of each of these circuits may be other circuits for limiting the voltage of the capacitor 54.

As described above, in the misfire detecting circuit in accordance with the first aspect to the present invention, since the current/voltage conversion means is formed of a circuit having a small input impedance, the time constant determined by stray capacitance and the resistance value of the circuit is decreased, and erroneous detection due to the influence by the stray capacitance is prevented without deteriorating current/voltage conversion characteristics (detection sensitivity). Thus, it is possible to provide a misfire detecting circuit having improved reliability.

In the misfire detecting circuit in accordance with the second aspect to the present invention, since a feedback circuit for removing dark current is disposed in the countermeasures, which circuit is disabled at a small number of rotations in which output from the operational amplifier is small and it is enabled at a great number of rotations in which output from the operational amplifier is great, erroneous detection due to dark current is prevented. Thus, it is possible to provide a misfire detecting circuit which has high reliability and which is capable of responding to a wide range of rotations of the engine.

In the misfire detecting circuit in accordance with the third aspect to the present invention, since a leak current compensating feedback circuit, connected between the output and the inverting input of the operational amplifier, for supplying the feedback current corresponding to the leak current, is disposed in the current/voltage conversion means, and a leak-current filter circuit, connected to the output of the operational amplifier, for removing the leak current is disposed in the waveform shaping means, erroneous detection due to the influence by leak current is prevented. Thus, it is possible to provide a misfire detecting circuit having improved reliability.

In the misfire detecting circuit in accordance with the fourth aspect to the present invention, a voltage limiting circuit for limiting the voltage of the capacitor of the ion current detecting means is formed of a transistor connected by emitter-grounded connection between the high potential side of the capacitor and the ground, and a voltage limiting element connected between the collector and the base of the transistor so that the transistor is turned on when a backward current flows through the voltage limiting element by a backward voltage and thus the power loss of the voltage limiting element is reduced. Thus, it is possible to provide a misfire detecting circuit which does not require a voltage limiting element having a high rated power, is easier to manufacture and whose manufacturing cost is low.

In the misfire detecting circuit in accordance with the fifth aspect to the present invention, a collector leak current prevention circuit for always applying a positive polarity voltage to the emitter of the transistor is further disposed in the voltage limiting circuit in accordance with the fourth aspect to the present invention so that leak current which flows from the capacitor to the collector of the transistor is prevented when ion current is detected. Thus, it is possible to provide a misfire detecting circuit which is free from erroneous detection of ion current due to leak current, and which has improved reliability.

In the misfire detecting circuit in accordance with the sixth aspect to the present invention, since, in addition to the capacitor for detecting ion current and a voltage limiting circuit, a power supply circuit for a circuit formed of a capacitor for a circuit power supply, which is charged by electric current from outside in the same way as in the capacitor for detecting ion current, and a voltage limiting circuit for a circuit power supply in the ion current detecting means are disposed in the ion current detecting means, a circuit power supply is not required. Thus, it is possible to provide a misfire detecting circuit having numerous advantages, such as improved degree of freedom of arrangement.

In the misfire detecting circuit in accordance with the seventh aspect to the present invention, since an output limiting means is further disposed on the output side of the misfire detecting circuit in accordance with the sixth aspect of the present invention, for limiting the output of the circuit when the voltage of the power supply circuit for a circuit falls below a predetermined value, erroneous detection due to the fact that the voltage of the power supply circuit for a circuit decreases is prevented. Thus, it is possible to provide a misfire detecting circuit having improved reliability.

What is claimed is:

1. A misfire detecting circuit for an internal combustion engine, said misfire detecting circuit comprising:

ion current detecting means for applying a positive polarity voltage to an ignition plug of a cylinder of an internal combustion engine and for detecting an ion current having a negative polarity; and current/voltage conversion means for converting said ion current to a positive polarity voltage, wherein said ion current detecting means comprises a capacitor for receiving a charge from an external electric current and for holding said positive polarity voltage, a voltage limiting circuit for limiting a voltage applied to the capacitor, and a first diode connected between an electrode on a low potential side of said capacitor and a ground, for enabling electric current to flow out of said capacitor, and wherein said current/voltage conversion means comprises a second diode having a cathode connected to a connection point of said capacitor and said first diode and an anode connected to the ground for supplying electric current to said capacitor, and a circuit having a small input impedance including an operational amplifier having an inverting input connected to the connection point of said capacitor and said first diode and having a non-inverting input connected to the ground, for converting ion current which flows out from said capacitor to a voltage, and for preventing erroneous detection of the ion current caused by the input impedance and stray capacitance.

2. A misfire detecting circuit for an internal combustion engine, said misfire detecting circuit comprising:

ion current detecting means for applying a positive polarity voltage to an ignition plug of a cylinder of an internal combustion engine and for detecting an ion current having a negative polarity; and current/voltage conversion means for converting said ion current into a positive polarity voltage, including an operational amplifier for converting the ion current to a voltage, and a feedback circuit for removing a dark current, the feedback circuit being disabled at low rotational speeds where the output of the operational amplifier is small and enabled at high rotational speeds where the output of the operational amplifier is large for preventing erroneous detection of the ion current due to the dark current.

3. A misfire detecting circuit for an internal combustion engine, said misfire detecting circuit comprising:

ion current detecting means for applying a positive polarity voltage to an ignition plug of a cylinder of an internal combustion engine and for detecting an ion current having a negative polarity;

current/voltage conversion means for converting said ion current into a positive polarity voltage and for outputting the positive polarity voltage on an output; and waveform shaping means for shaping the positive polarity voltage, wherein said ion current detecting means comprises an operational amplifier for converting the ion current into a voltage, and a leakage current compensating feedback circuit, connected between the output and an inverting input of the operational amplifier, for supplying a feedback current corresponding to the leakage current and said waveform shaping means includes a leakage-current filter circuit, connected to an output of said operational amplifier, for removing the leakage current, and an output of said leakage-current filter circuit being used as an output of the misfire detecting circuit for preventing erroneous detection of the ion current due to the leakage current.

4. A misfire detecting circuit for an internal combustion engine, said misfire detecting circuit comprising:

ion current detecting means for applying a positive polarity voltage to an ignition plug of a cylinder of an internal combustion engine and for detecting an ion current having a negative polarity; and current/voltage conversion means for converting the ion current into a positive polarity voltage, wherein said ion current means comprises a capacitor for receiving a charge from an external electric current and for holding the positive polarity voltage, a diode connected between an electrode on a low potential side of said capacitor and a ground, for allowing electric current to flow out from said capacitor, and a voltage limiting circuit for limiting a voltage of said capacitor, the voltage limiting circuit including a transistor having an emitter coupled to the ground and a collector connected to a high potential side of said capacitor, and a base of the transistor, for turning on said transistor when a backward current flows through said voltage limiting element to reduce a power loss of said voltage limiting element.

5. A misfire detecting circuit according to claim 4, wherein said voltage limiting circuit of said ion current detecting means further comprises a collector leakage current prevention circuit for preventing leakage current from flowing from said capacitor to the collector of said transistor by always applying a positive polarity voltage to the emitter of said transistor.

6. A misfire detecting circuit for an internal combustion engine, said misfire detecting circuit comprising:

ion current detecting means for applying a positive polarity voltage to an ignition plug of a cylinder of an internal combustion engine and for detecting an ion current having a negative polarity; and current/voltage conversion means for converting said ion current into a positive polarity voltage, wherein said ion current detecting means comprises a first capacitor for receiving a charge from an external electric current, for holding said positive polarity voltage and for detecting an ion voltage responsive to the ion current, a voltage limiting circuit for limiting a voltage of said first capacitor, a first diode having an anode connected to an electrode on a low potential side of said first capacitor, for causing electric current to flow out of said first capacitor, and a power-supply circuit including a second capacitor for receiving a charge from the external electric current for detecting the ion current and for holding the positive polarity voltage, and a second voltage limiting circuit for limiting a voltage of said second capacitor.

7. A misfire detecting circuit according to claim 6 further comprising output limiting means included in an output circuit of said misfire detecting circuit for limiting an output voltage when the voltage of said second capacitor falls below a predetermined value.

* * * * *